United States Patent [19]

Sakuma et al.

[11] 3,933,362

[45] Jan. 20, 1976

[54] SKI HAVING A HOLLOW CORE

[75] Inventors: Kenichi Sakuma; Ryozi Tanahashi, both of Hamamatsu, Japan

[73] Assignee: Nippon Gakki Seizo Kabushiki Kaisha, Hamamatsu, Japan

[22] Filed: Mar. 21, 1975

[21] Appl. No.: 560,592

[30] Foreign Application Priority Data

Mar. 25, 1974 Japan ..... 49-33257
Mar. 28, 1974 Japan ..... 49-34359

[52] U.S. Cl. ..... 280/11.13 L
[51] Int. Cl.[2] ..... A63C 5/12
[58] Field of Search ..... 280/11.13 L, 11.13 M, 280/11.13 G, 11.13 R

[56] References Cited

UNITED STATES PATENTS

| | | | |
|---|---|---|---|
| 3,374,001 | 3/1968 | Baudou | 280/11.13 M |
| 3,493,240 | 2/1970 | Jenks | 280/11.13 L |
| 3,614,116 | 10/1971 | Haldemann | 280/11.13 L |
| 3,628,802 | 12/1971 | Hashimoto et al. | 280/11.13 L |
| 3,736,609 | 6/1973 | Saucier | 280/11.13 L |

FOREIGN PATENTS OR APPLICATIONS

| | | |
|---|---|---|
| 1,809,011 | 6/1970 | Germany |

*Primary Examiner*—Leo Friaglia
*Assistant Examiner*—David M. Mitchell
*Attorney, Agent, or Firm*—Cushman, Darby & Cushman

[57] ABSTRACT

In a ski of the type comprising a hollow core assembly provided with a ski top constituting unit, a ski bottom constituting unit which are firmly laminated to the top side and the bottom side of said hollow core assembly, and side members arranged at the lateral sides of this assembly, the hollow core assembly has, at a substantially central part of the ski relative to the transverse direction of this ski, a hollow structure defined (a) by a longitudinally extending central channel member having a substantially U-shaped cross section and made of a fiber-reinforced plastic, and (b) by a cover plate firmly secured to the end edges of the two legs of said U-shaped central channel member to cover the opening of said U-shape. This core assembly has flanking members made of such material as foamed hard polyurethane resin, wood pieces or honeycomb and securely bonded to the lateral sides of the hollow structure to sandwich the hollow structure therebetween and extending longitudinally of the ski.

5 Claims, 9 Drawing Figures

SKI HAVING A HOLLOW CORE

BACKGROUND OF THE INVENTION a. Field of the invention:

The present invention is concerned with a ski of the hollow core assembly type having a centrally longitudinally extending hollow structure sandwiched between two flanking members.

b. Description of the prior art:

As a means of improving the function and operability of skis, there has been the concept to reduce the total weight of the ski as much as possible.

In order to attain this reduction of the total weight of the ski, there has been practiced in general to provide a ski having a hollow-structured core assembly which constitutes the main part of the ski and which is comprised generally of a central core member and flanking members sandwiching the central core member therebetween. However, it is presently considered quite difficult in the ski manufacturing industry to form a hollow structure within the core assembly, as considered from its relation with the ski top and bottom constituting units which are to be laminated on the top and bottom sides of the core assembly, respectively. A brief description will hereunder be made on the known manner of forming a hollow structure within the core assembly of a ski. As shown in FIG. 9, a central core member 1 made of a glass fiber-reinforced plastic (which will hereinafter to be referred to briefly as FRP) and cross-sectionally having a U-shaped channel is provided to extend longitudinally in the central part of the ski. On the lateral sides of this central core member 1 are provided flanking members 2 and 2 made of a material such as a foamed hard polyurethane resin, wood pieces or honeycomb. The central core member 1 and the flanking members 2 and 2, in combination, constitute a core assembly 3. To the extreme lateral sides of this core assembly 3 are firmly secured side members 4 and 4, and to the top side of the core assembly 3 is firmly laminated a ski top constituting unit which is comprised of a top plate 5 made of FRP, top edges 6 and 6 and a ski surface decorating member 7. To the bottom side of the core assembly 3 is firmly laminated a ski bottom constituting unit which is comprised of a bottom plate 8 made of FRP, sole edges 9 and 9 and a gliding surface member 10. This cross-sectionally U-shaped central core member 1 has, accordingly, a longitudinally extending channel of a U-shaped cross section and its opening is covered with the top plate 5 made of FRP, thereby presenting a hollow portion 11 in the ski. It should be noted that, in a conventional ski having the aforesaid core assembly arrangement, the plane of bonding between the end edges of the opening of the U-shaped central core member 1 and the top plate 5 made of FRP tends to be broken or become separated apart relative to each other by the concentrated application, to this plane of bonding, of considerable amounts of shearing forces caused by the impacts and vibrations which occur during the operation of the ski. Thus, such a ski can be said to be exposed to a great deal of danger during its use and to be poor in its mechanical strength and short in its service life. Moreover, when, at the time of manufacture of such a ski, it is intended to laminate the top plate 5 made of FRP onto the core assembly 3 by bonding them together, it is mandatory that this top plate 5 of FRP be made with separately prepared semi-hardened resin-impregnated sheets, i.e., prepreg sheets, and therefore, there occurs the inconvenience that, during the heat-pressing step at the time of forming the whole core assembly, the FRP resin of the top plate oozes into the space in the U-shaped channel of the central core member 1, adversely affecting the formation of a desirable neat shape of the U-shaped channel, causing a subtle disorder of the structural balance of the ski as a whole.

SUMMARY OF THE INVENTION

It is, therefore, a primary object of the present invention to improve the aforesaid inconvenience and drawback of the skis of the hollow core assembly type of the prior art and to provide a ski which is light in weight and which can be built so as to be able to resist the shearing force applied to the ski during use without sacrificing this light weight and which is of a prolonged service life.

Another object of the present invention is to provide a ski which is easy to manufacture and which can be made without any substantial increase in the cost of manufacture.

These and other objects as well as the features and advantages of the present invention will become apparent from the followed detailed description of the invention.

BRIEF DESCRIPTION OF THE DRAWINGS

Like parts are indicated by like reference numerals for the simplicity of explanation.

DETAILED DESCRIPTION OF THE PREFERRED EMBODIMENTS

Description of an example of the ski according to the present invention will be made hereunder by referring to FIGS. 1 through 6.

Figure 1:
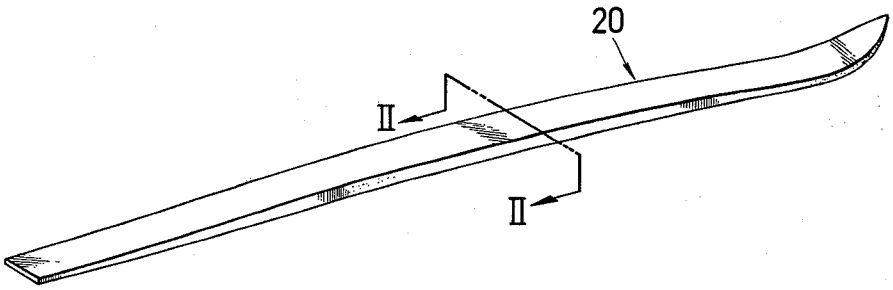
FIG. 1 is a perspective external view of an example of the ski according to the present invention.
Figure 2:
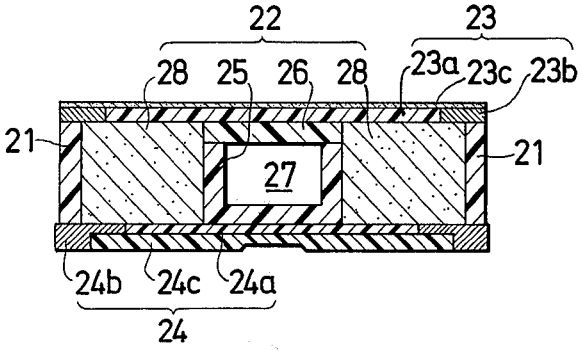
FIG. 2 is a view taken along the line II—II in FIG. 1.

FIG. 2 shows an example of the ski 20 of this invention taken in a transverse vertical section. The ski includes a hollow core assembly 22, a ski top constituting unit 23 and a ski bottom constituting unit 24 which are laminated on the top and the bottom sides of the hollow core assembly 22, respectively. The ski top constituting unit 23 is comprised of a top plate **23*a* made of FRP, top edges 23*b* and 23*b* and a ski surface decorating member 23*c*. The ski bottom constituting unit 24 is comprised of a bottom plate 24*a* made of FRP, sole edges 24*b* and 24*b* and a glinding surface member 24*c*. The hollow core assembly 22 includes therein a hollow structure 27 which is defined (1) by a central channel member 25 made of FRP and having a substantially U-shaped cross section and is positioned at substantially the central part of the ski relative to the transverse direction thereof and extends longitudinally of the ski, and (2) by a cover plate 26 made of FRP and tightly covering the opening of said U-shaped central member 25 and having a flat outer surface, said opening being defined between the two legs of the U-shape on the free end side of these legs. The hollow core assembly 22 is comprised of the hollow structure and two flanking members 28 and 28 having substantially flat upper and lower surfaces and sandwiching this hollow structure 27 therebetween, which members being made of a material such as a foamed hard polyurethane resin, wood pieces or honeycomb and are firmly bonded to the lateral sides of the hollow structure. In this example, these two flanking members 28 and 28** are provided in such a way that their upper surfaces lie substantially in the same plane with the outer or the upper surface of the hollow structure.

Figure 4:
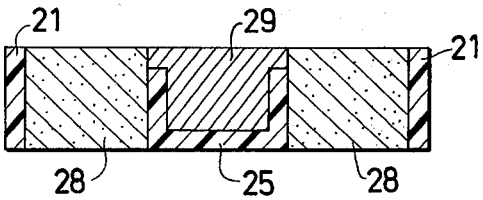
FIGS. 4 through 6 are explanatory illustrations to show the steps of forming the hollow core assembly of the ski according to the present invention.
Figure 3:
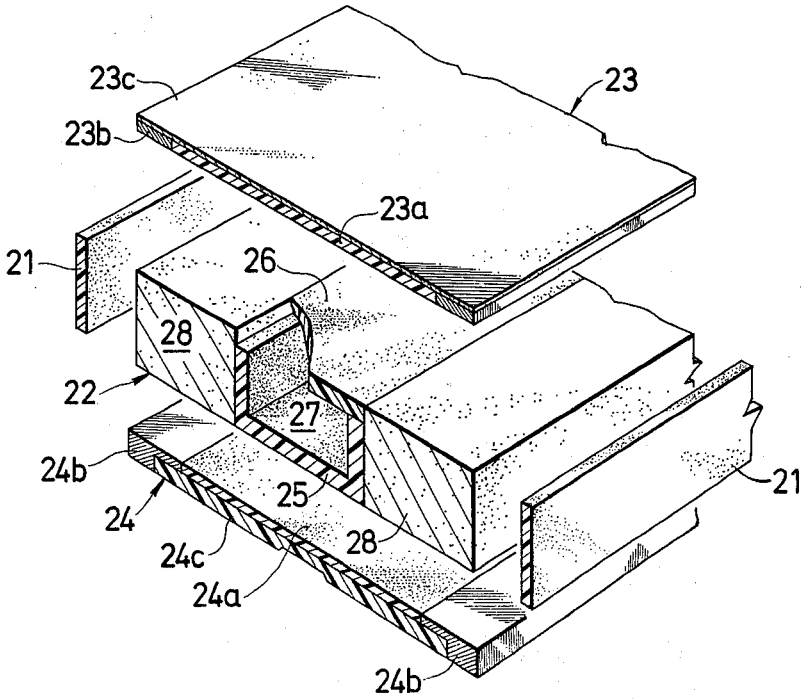
FIG. 3 is an exploded perspective view of the ski of FIG. 1.
Figure 5:
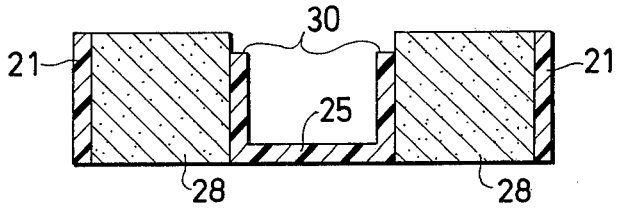
Figure 6:
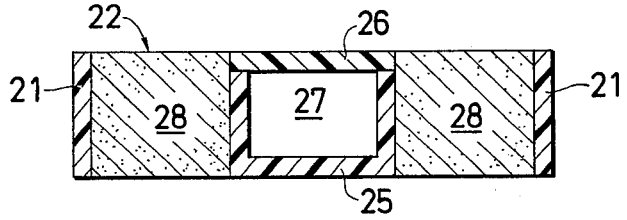

The hollow core assembly 22 is formed in the manner as shown in FIGS. 4 through 6. Pre-preg FRP sheets not completely hardened yet are molded into a substantially U-shaped central channel member 25, by the use of a dummy 29. Then, while keeping this dummy 29 in the state of being engagingly fit in this central channel member 25, flanking members 28 and 28 together with side members 21 and 21 are bonded to the sides of the central channel member 25, respectively. FIG. 4 shows this state. In this part of the hollow core assembly forming process, it should be noted that the central channel member 25 is prepared so that the end edges of the legs of the central channel member 25 defining an opening therebetween are positioned, when this central channel member 25 is sandwiched in place between the flanking members 28 and 28, lower than the upper planes of these two flanking members for a certain distance; in other words, there is formed a depth from the upper surface lines of the flanking members 28 and 28 up to the end edges of the opening of the central channel member 25 for a distance corresponding exactly to the thickness of the cover plate 26 which is used for covering the opening defined between the two legs of the central channel member 25. It should be noted that the central channel member 25 having such a dimension and shape as discussed above can be made in a very simple manner by molding it with a dummy 29 as referred to above, and by molding the cover plate separately from the central channel member 25. However, any other forming method may be used. For example, a dummy 29 having a rectangular cross section and having a thickness identical with the aforesaid depth of the upper edges of the central channel member 25 is combined with not completely hardened pre-preg FRP sheets which are laminated for forming the central channel member 25. On top of this combined items is placed a plurality of not completely hardened pre-preg FRP sheets which are used for forming the cover plate 26 and which are wrapped in a plastic film for later easy detachment of the cover plate from the mating molded article and the mold. The resulting assembly of parts is then subjected to heat molding. Thereafter, the wrapped-up molded cover plate 26 is removed from the mold, and the dummy 29 is withdrawn. Thus, it is possible to mold both the central channel member 25 and the cover plate 26 at the same time. Then, as shown in FIG. 5, the dummy 29 is withdrawn from the central channel member 25. Thereafter, the unwrapped cover plate 26 is fit in the depths or the shouldered portions 30 and 30 which are formed on the end edges of the legs of the central channel member 25 and this cover plate 26 is bonded firmly to these end edges. In this way, a core assembly 22 having a hollow portion 27 therein is obtained. FIG. 6 is vertical sectional view of this hollow core assembly 22.

As stated above, in the ski according to the present invention, the hollow structure 27 is formed in substantially the central part of the core assembly 22 by the central channel member 25 having a U-shaped cross section, the cover plate 26 and the two flanking members 28 and 28. This hollow portion 27 is formed in the following manner. The end edges of the two legs of said central channel member 25 are prepared so that they are positioned lower than the upper planes of the flanking members 28 and 28 when assembled together and a cover plate 26 is fit in this depth or the shouldered portions 30 and 30 and is bonded to these end edges in such a way that the outer surface of the cover plate 26 lies in the same plane with the upper flat surfaces of the two flanking members 28 and 28. As a result, the shearing force which is applied to the top plate **23*a* is supported almost evenly by the entire cover plate 26 throughout the surface area thereof and by the two flanking members 28 and 28, and no detachment of the cover plate 26 from the end edges of the hollow structure 27 occurs. Accordingly, it is possible to improve the service life of the ski 20 without causing the breaking of the top plate 23*a* made of FRP which is laminated on top of the hollow core assembly 22. Also, at the time when this top plate 23*a* is laminated on top of the hollow core assembly 22, semi-hardened pre-preg FRP sheets which are formed into this top plate 23*a* are laminated on top of the core assembly 22 and then these sheets are subjected to heat-pressing. Nevertheless, the resin will never ooze into the space of the hollow portion 27 of the U-shaped central channel member 25 by being blocked by the cover plate 26, whereby it is possible to accomplish the predetermined exact shaping of the hollow structure 27**.

In the above-discussed example, side members are bonded to the outer sides of the two flanking members 28 and 28 which constitute parts of the hollow core assembly. It should be noted, however, that these flanking members may be formed with a formed hard polyurethane resin and those "skin layers" having an increased density of foam which are produced at the outer side edge portions of the flanking members by the pressure generated at the time of foaming may be used concurrently to serve as the side members 21 and 21.

Figure 7:
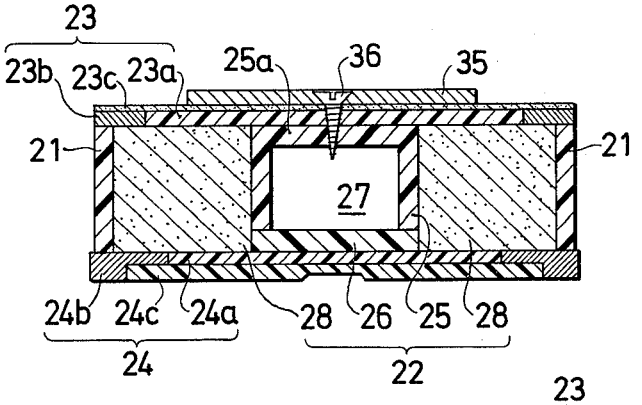
FIG. 7 is a transverse vertical sectional view of another example of the ski according to the present invention.

FIG. 7 shows another embodiment of the ski according to the present invention. This ski is comprised, similarly to the preceding embodiment, of a hollow core assembly 22 having side members 21 and 21 bonded to the lateral sides thereof, a ski top constituting unit 23, and a ski bottom constituting unit 24. This ski top constituting unit 23, in turn, is comprised of a top plate **23*a* made of FRP, top edges 23*b* and 23*b* and a ski surface decorating member 23*c*. Also, the ski bottom constituting unit 24 is comprised of a bottom plate 24*a* made of FRP, sole edges 24*b* and 24*b* and a glinding surface member 24*c*. The hollow core assembly 22 of this second example has a substantially U-shaped channel provided at substantially the central part thereof as in the preceding example. However, this hollow core assembly 22 includes therein a hollow structure 27 made of FRP, which structure 27 is formed by a central channel member 25** having a substantially U-shaped cross section whose opening faces, in this example, the bottom of the ski which is the opposite arrangement in position of the opening of the preceding example, and also by a cover plate 26 for covering said opening of the central channel member 25 and by the two flanking members described below. Like the preceding example, this opening is defined between a pair of legs of the central channel member on the free end side of these legs. At the lateral sides of this hollow structure 27 are arranged flanking members 28 and 28 which are made of a material such as a foamed hard polyurethane resin, wood pieces or honeycomb and which in this second embodiment are bonded to the hollow structure 27 at the lateral sides thereof in such a way that the top and the bottom planes of these flanking members lie in the same plane with the top and the bottom surfaces of the hollow structure, respectively.

As in the preceding example, the end edges of the two legs of the opening of the central channel member are positioned higher than or short of the bottom surface lines of the two flanking members 28 and 28 for a distance corresponding to the thickness of the cover plate 26.

The ski having the aforesaid core assembly structure is of the arrangement that the opening of the central channel member 25 which constitutes a part of the hollow core assembly and whose channel has a substantially U-shaped cross section and is positioned at substantially the central part of the hollow core assembly 22 faces the bottom of the ski. Accordingly, in this example, a screw 36 is used to securely attach a base plate 35 for a fastening member or binding to the upper central surface of the ski 20 by threading this screw 36 into the upper surface of the base plate 35 through the base wall 25a of the central channel member 25. Moreover, the central channel member 25 is bonded firmly to the flanking members 28 and 28 at both lateral sides and is positively supported by these flanking members. Thus, it is possible to improve the holding force of the screw 36. Furthermore, the opening formed between the two legs of the central channel member 25 is covered tightly by the cover plate 26 which is securely bonded to the two end edges of the opening, and the bottom surface of this cover plate 26 lies in the same plane with the bottom surfaces of the two flanking members 28 and 28. A bottom plate 24a is firmly bonded to the bottom surface of the resulting hollow core assembly 22. Accordingly, the shearing force which is applied to the bottom plate 24a and produced at the inter-face of bonding between the end edges of the central channel member 25 and the cover plate 26 is supported almost evenly by this cover plate 26 and the flanking members 28 and 28, without causing any detachment of the cover plate 26 from the end edges of the hollow structure 27. Thus, the shearing force will hardly act upon the bottom plate 24a made of FRP which is laminated to the bottom side of the core assembly 22. As a result, it is possible to improve the durability of the ski.

Figure 8:
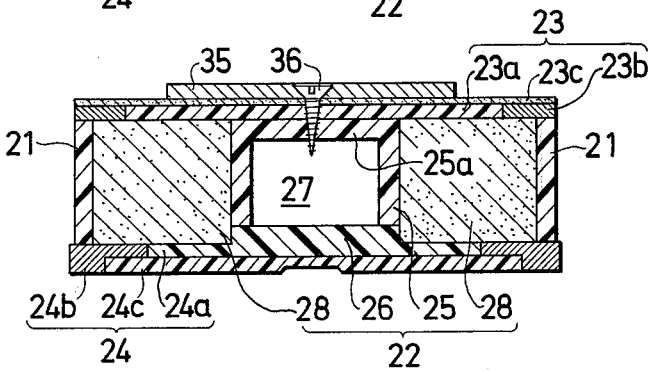
FIG. 8 is a transverse vertical sectional view of a still another example of the ski according to the present invention showing an integral structure of the cover plate and the bottom plate.
Figure 9:
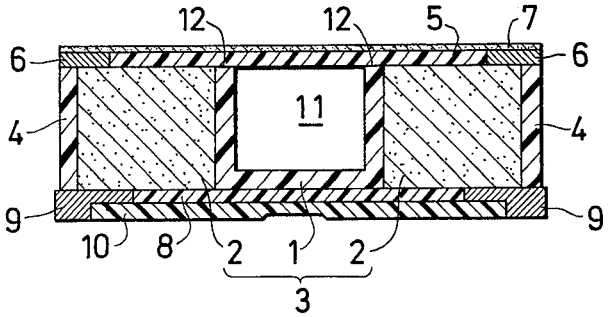
FIG. 9 PRIOR ART
FIG. 9 is a transverse vertical sectional view showing an example of the known skis.

It should be noted that description has been made of examples wherein the top and bottom faces of the cover plate 26 in each example are of substantially flat surfaces. However, these are some examples which are selected by the choice of the users. Depending on the designing of the cover plate, the latter may have an outer surface which is integrally united with the bottom plate 24*a* as shown in FIG. 8. Accordingly, the appearance of this cover plate 26 gives the impression of having an uneven outer surface. Nevertheless, the function as well as the principle of the present invention are the same as those of the preceding examples.

It should be noted also that the side plates may be made of a phenolic resin or acrilonitrilebutadiene-styrene (ABS) resin. Further, instead of FRP, other fiber reinforced plastics may be used. For example, carbon fibers may be used as such reinforcing fibers.

As discussed above, according to the present invention, there is provided an improvement that, in a ski having a core assembly provided with a ski top constituting unit and a ski bottom constituting unit which are laminated on the top and the bottom surfaces of the core assembly, the core assembly includes therein a hollow structure defined (1) by a central channel member made of a fiber reinforced plastic and having a substantially U-shaped cross section and positioned substantially in the central part of the ski relative to the transverse direction of the ski and extending longitudinally of this ski, and (2) by a cover plate covering the opening of the U-shape of the central channel member, the core assembly further includes two flanking members bonded to the lateral sides of the hollow structure in such a way that the upper surfaces and the lower surfaces of these flanking members lie in the same plane as the upper surface and the lower surface of the hollow structure. Thus, by forming a hollow portion within the core assembly which constitutes the main part of the ski, the latter body as a whole can be provided so as to have a greatly reduced total weight. Also, the opening of the central channel member which constitutes a part of the hollow core assembly is covered by a cover plate and moreover the outer surface of the cover plate lies in a plane same as those planes of the upper or the lower surface of the two flanking members sandwiching the hollow structure therebetween. Thus, the end edges of the legs of the central channel member are not arranged to be brought into direct contact with either the ski top constituting unit or the ski bottom constituting unit which is laminated to the top or the bottom surface of the hollow core assembly. Accordingly, it is possible to form, within the ski, a closed transverse vertical section by the central channel member, the cover plate and the two flanking members. Thus, the shearing force which is produced at the interface of bonding of the end edges of the central channel member is distributed evenly throughout the cover plate and also the shearing force applied to the top plate or the bottom plate is supported evenly by the cover plate and the flanking members. The cover plate, sandwiched between the two flanking members, can effectively withstand the shearing force applied to the top or bottom plate, preventing the breakage between the central channel member and the top or bottom plate. Therefore, it is possible to increase the mechanical strength of the ski without damaging the light weight feature of the ski. Thus, it is possible to attain the objects of the present invention without substantially altering the design of known skis and their manufacturing techniques.

We claim:

1. A ski having a hollow core assembly provided with a ski top constituting unit firmly laminated to the top surface of the core assembly, and a ski bottom constituting unit firmly laminated to the bottom side of said core assembly, said hollow core assembly comprising:

a central channel member having a substantially U-shaped cross section and being positioned at a substantially central part of the ski relative to the transverse direction thereof and extending longitudinally thereof, said central channel member of U-shaped cross section having a pair of leg members defining an opening therebetween on the free end side thereof, two flanking members secured firmly to the lateral sides of said central channel member, respectively, and each having a substantially flat surface on that side of the ski which is faced by said opening of the U-shaped central member, said end edges of the substantially U-shaped central member being positioned short of said substantially flat surfaces of the two flanking members, defining a space between the two flanking members on the free end side of the leg members of the central channel member, and a cover plate covering the opening of said U-shaped central channel member and being bonded firmly to the end edges of said central channel member, said cover plate being sandwiched between the flanking members within said space defined therebetween, whereby said core assembly has therein a longitudinally extending central hollow structure at substantially the central part of the ski relative to the transverse direction thereof.

2. A ski having a hollow core assembly according to claim 1, in which said end edges of the central channel member faces the top surface of the ski.

3. A ski having a hollow core assembly according to claim 1, in which said end edges of the central channel member faces the bottom surface of the ski.

4. A ski having a hollow core assembly according to claim 1, in which said end edges of the central channel member faces the bottom surface of the ski, and the cover plate is integral as a onepiece with a bottom plate of the ski.

5. A ski having a hollow core assembly according to claim 1, in which said central channel member and the cover plate are made with a fiber reinforced plastic and said flanking members are made with a foamed hard polyurethane resin.

* * * * *

UNITED STATES PATENT OFFICE

CERTIFICATE OF CORRECTION

PATENT NO. : 3,933,362

DATED : January 20, 1976

INVENTOR(S) : Ken-ichi SAKUMA and Ryozi TANAHASHI

It is certified that error appears in the above-identified patent and that said Letters Patent are hereby corrected as shown below:

On the front page, just below the ABSTRACT read "5 Claims" as --- 7 Claims --- .

In column 8, after claim 5, read the patent as containing the following claims 6 and 7:

6. A ski having a hollow core assembly according to claim 1, in which said central channel member and the cover plate are made with a fiber reinforced plastic and said flanking members are made with wood pieces.

7. A ski having a hollow core assembly according to claim 1, in which said central channel member and the cover plate are made with a fiber reinforced plastic and said flanking members are made with a honeycomb material.

Signed and Sealed this

*thirteenth* Day of *April 1976*

[SEAL]

*Attest:*

RUTH C. MASON
*Attesting Officer*

C. MARSHALL DANN
*Commissioner of Patents and Trademarks*